US008794791B2

(12) United States Patent
Guo et al.

(10) Patent No.: US 8,794,791 B2
(45) Date of Patent: Aug. 5, 2014

(54) LIGHT-EMITTING-DIODE-BASED LIGHT BULB

(75) Inventors: Sheng-Shin Guo, Wufeng Township (TW); Wei-Yu Yeh, Tainan (TW); Chih-Hsuan Sun, Kaohsiung (TW); Pei-Wen Ko, Zhubei (TW)

(73) Assignee: TSMC Solid State Lighting Ltd., Hsin-Chu (TW)

( * ) Notice: Subject to any disclaimer, the term of this patent is extended or adjusted under 35 U.S.C. 154(b) by 302 days.

(21) Appl. No.: 13/151,857

(22) Filed: Jun. 2, 2011

(65) Prior Publication Data

US 2012/0306341 A1 Dec. 6, 2012

(51) Int. Cl.

| | |
|---|---|
| ***F21V 1/00*** | (2006.01) |
| ***F21V 11/00*** | (2006.01) |
| ***F21V 7/00*** | (2006.01) |

(52) U.S. Cl.
USPC ..... 362/247; 362/235

(58) Field of Classification Search
USPC ..... 362/235, 247; 313/113
See application file for complete search history.

(56) References Cited

U.S. PATENT DOCUMENTS

| | | | | |
|---|---|---|---|---|
| 7,347,586 | B2 | 3/2008 | Izardel | |
| 7,350,936 | B2 | 4/2008 | Ducharme et al. | |
| 2004/0105262 | A1 * | 6/2004 | Tseng et al. | 362/241 |
| 2005/0168986 | A1 * | 8/2005 | Wegner | 362/241 |
| 2005/0189557 | A1 | 9/2005 | Mazzochette et al. | |
| 2005/0213324 | A1 * | 9/2005 | Chen | 362/249 |
| 2006/0250792 | A1 * | 11/2006 | Izardel | 362/231 |
| 2007/0097678 | A1 | 5/2007 | Yang | |
| 2008/0278956 | A1 * | 11/2008 | Boyer | 362/373 |
| 2010/0002444 | A1 | 1/2010 | Konaka | |
| 2011/0001417 | A1 | 1/2011 | Stekelenburg | |
| 2011/0006679 | A1 | 1/2011 | Stekelenburg | |
| 2011/0039471 | A1 * | 2/2011 | Scott | 445/23 |

OTHER PUBLICATIONS

Press Release Jan. 26, 2011, "Panasonic to Release Everleds LED Bulbs with Wide Light Distribution Angle of Approximately 300 Degrees", http://panasonic.co.jp/corp/news/official.data/data.dir/en110126-6/en110126-6.html.

* cited by examiner

*Primary Examiner* — Anh Mai
*Assistant Examiner* — Zachary J Snyder
(74) *Attorney, Agent, or Firm* — Haynes and Boone, LLP

(57) ABSTRACT

The embodiments of a light-emitting-diode-based (LED-based) light bulb and an LED assembly described provide mechanisms of reflecting generated by LED emitters toward the back of the LED-based light bulb. An upper substrate and a lower substrate are used to support upper and lower LED emitters. A slanted and reflective surface between the upper substrate and the lower substrate reflects light generated by the lower LED emitters toward the backside of the LED-based light bulb.

19 Claims, 9 Drawing Sheets

LIGHT-EMITTING-DIODE-BASED LIGHT BULB

BACKGROUND

The present disclosure relates generally to a lighting device and, more particularly, to a lighting device involving lighting emitting diodes (LEDs).

As the concerns for energy price and environment continuously increase, people are looking into ways to reduce energy consumption and to lengthen the lifetimes of lighting devices. Incandescent light bulbs (or lamps) known to the inventors have shorter life times and consume significantly more energy to achieve the same level of lighting performance in comparison to light bulbs made with LED devices.

A Light-Emitting Diode (LED), as used herein, is a semiconductor light source for generating light at a specified wavelength or a range of wavelengths. An LED emits light when a voltage is applied across a p-n junction formed by oppositely doping semiconductor compound layers of the LED. Different wavelengths of light can be generated using different materials by varying the bandgaps of the semiconductor layers and by fabricating an active layer within the p-n junction. With the increased concerns for energy price and environment, there is a continuing effort in developing improved LED light bulbs to replace known incandescent light bulbs.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
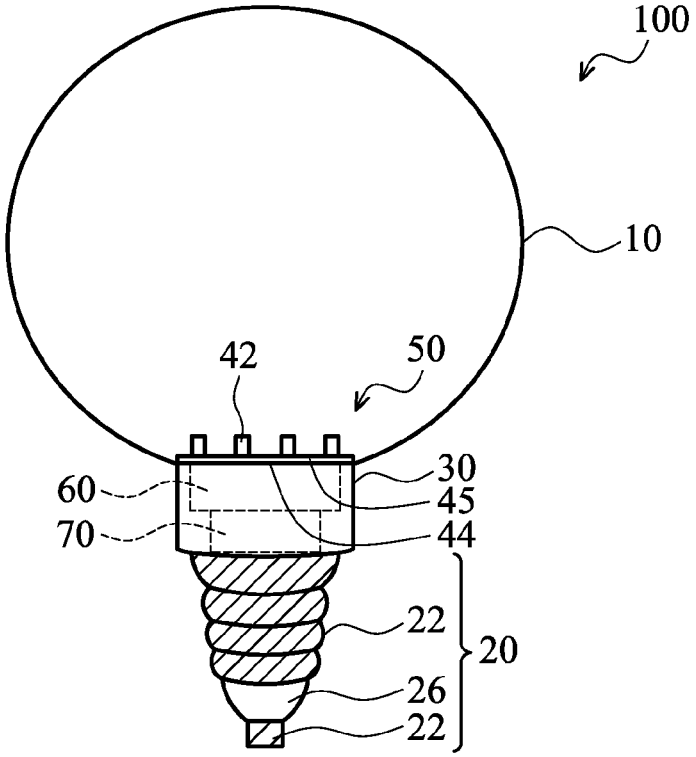
FIG. 1A is a side view of a light-emitting-diode-based (LED-based) light bulb, in accordance with some embodiments.

It is understood that the following disclosure provides many different embodiments, or examples, for implementing different features of various embodiments. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. Of course, the description may specifically state whether the features are directly in contact with each other. In addition, the present disclosure may repeat reference numerals and/or letters in the various examples. This repetition is for the purpose of simplicity and clarity and does not in itself dictate a relationship between the various embodiments and/or configurations discussed.

FIG. 1A is a side view of an LED-based light bulb 100, in accordance with some embodiments. The LED-based light bulb 100 has a bulb for light permeable shell) 10, a base 20, a housing 30, and an LED assembly 50. The bulb 10 is mounted on the housing 30 and may be made of various materials, such as glass. In some embodiments, bulb 10 may be clear or frosted to diffuse the light. The housing 30 is hollow and is adapted to mount on the base 20. A number of components to control, to cool, and/or to support the functions of the LED-based light bulb 100 may be placed inside the hollow housing 30. The base 20 is used to mount the LED-based light bulb 100 in an electrical socket, in accordance with some embodiments. The base 20 may include a bottom contact 25, a metallic element 22, and an insulating element 26. The bottom contact 25 and the metallic element 22 may be used for opposite electrical terminals. For example, the bottom contact 25 may be a positive terminal and the metallic element 22 may be a negative terminal, or vice versa. The insulating element 26 is placed between the bottom contact 25 and the metallic element 22 to electrically separate them from each other.

The LED assembly 50 may include a single or a number of LED light emitters 42 mounted on a substrate 45. The substrate 45 is at least at the same level as the interface 44 between the bulb 10 and the housing 30. The substrate 45 can be placed above the interface 44. If a number of LED light emitters 42 are mounted on substrate 45, the LED light emitters are electrically connected to one another. The electrical connection could he serial, parallel, or a combination thereof LED light emitters 42 may be made by growing a plurality of light-emitting structures on a growth substrate. The light-emitting structures along with the underlying growth substrate are separated into individual LED dies. At some point before or after the separation, electrodes or conductive pads are added to the each of the LED dies to allow the conduction of electricity across the structure. LED dies are then packaged by adding a package substrate, optional phosphor material, and optical components such as lens(es) and reflector(s) to become light emitters, in accordance with some embodiments.

On the backside of substrate 45, there could be electrical connecting devices (not shown), such as wires or other types of connections, that provide electrical contacts between the LED light emitters 42, the bottom contact 25 and the metallic element 22 described above. On the backside of substrate 45, there could be a heat sink 60 physically coupled to substrate 45 to dissipate the heat generated by the LED light emitters 42, in accordance with some embodiments. In some embodiments, there is an electrical circuit assembly 70 on the backside of substrate 45 and in the hollowed space within the housing 30 and/or base 20. The electrical circuit assembly 70 is electrically connected to the LED light emitters 42, the bottom contact 25 and the metallic element 22. It may be used to adjust power taken in from an external power source to current/voltage for lighting the LED light emitters 42. The electrical circuit assembly 70 may also perform other control functions, such as controlling the amount of light emitted by the LED light emitters 42, etc.

Figure 1B:
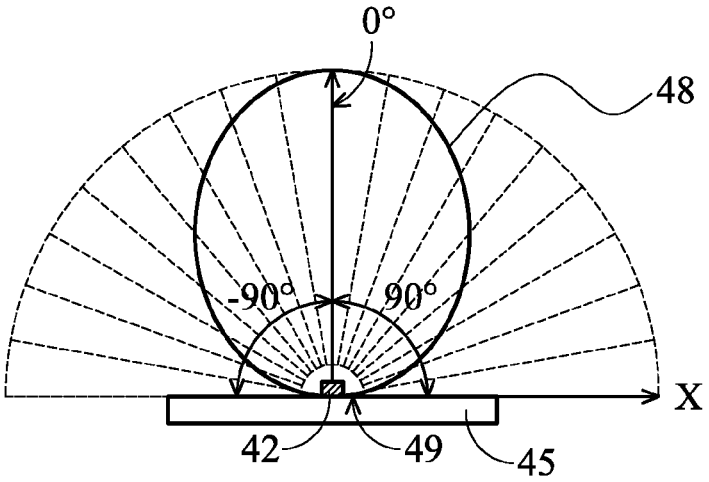
FIG. 1B is a diagram of horizontal and vertical light patterns of an LED-based light bulb, in accordance with some embodiments.

FIG. 1B is a perspective view of an exemplary light pattern emitted by an LED light emitter 42, in accordance with some embodiments, The LED light emitter 42 is one of the LED light emitters 42 described above, in accordance with some embodiments. The LED light emitter 42 is placed on the substrate 45, which has a front surface 49 The LED light emitter 42 emits light in a forward direction (in front of substrate 45). Curve 48 shows the angle distribution of light emitted by emitter 42, in accordance with some embodiments. The axis Y is perpendicular to the front surface 49 and has an angle 0°. In contrast, the axis X is parallel to the front surface 49 and has an angle 90° in the right direction and an angle −90° in the opposite direction, as shown in FIG. 1B. The length of the light pattern in a particular direction reflects the intensity of light in that particular direction. FIG. 1B shows that the intensity of light is highest at angle 0° and there is almost no light at or near angle 90° or −90°. FIG. 1B also shows that no light is directed toward the backside of substrate 45 and the light emitted by an LED light emitter 42 is mainly directed away from the front side 49 of substrate 45. The LED assembly 50 of FIG. 1A is made of a number of LED light emitters 42. As a result, the light pattern generated by the LED assembly 50 is mainly directed forward with no light directed toward the backside of substrate 45 (or at angles equal to or greater than 90° or less than −90°).

Figure 1C:
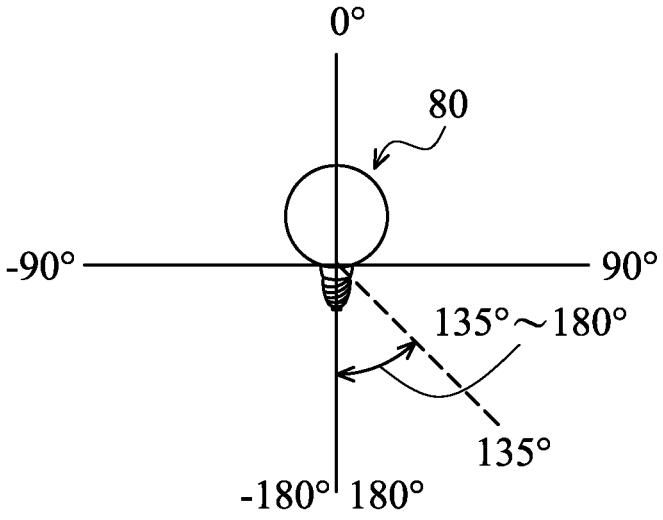
FIG. 1C is a diagram of light angles of an LED-based light bulb, in accordance with sonic embodiments.

Incandescent light bulbs known to the inventors that generate light by heating up metal filament wires shine light in all directions, ENERGY STAR™ that sets standards for energy efficient consumer products has standards for LED-based light bulbs that intend to replace the traditional incandescent light bulbs. One of the standards for omnidirectional LED-based light bulbs is to emit light toward the backside as well as toward the front side of the light bulbs to mimic the lighting pattern of conventional incandescent light bulbs, The ENERGY STAR™ standard for omnidirectional LED-based light bulbs is to have at least 5% of light (or flux) emitting in the zone from 135° to 180° out of the 0° to 180° angle range. FIG. 1C shows light angles of an LED-based light bulb 80, in accordance with some embodiments. FIG. 1C is a diagram of the zone (or region) of 135° to 180°, where the LED-based light bulb 80 needs to emit at least about 5% of light emitted from 135° to 180°. The embodiment of LED-based light bulb 100 described above in FIG. 1A would not emit light at angles greater than 90°. Therefore, there is a need to find different designs of light bulbs.

Figure 1D:
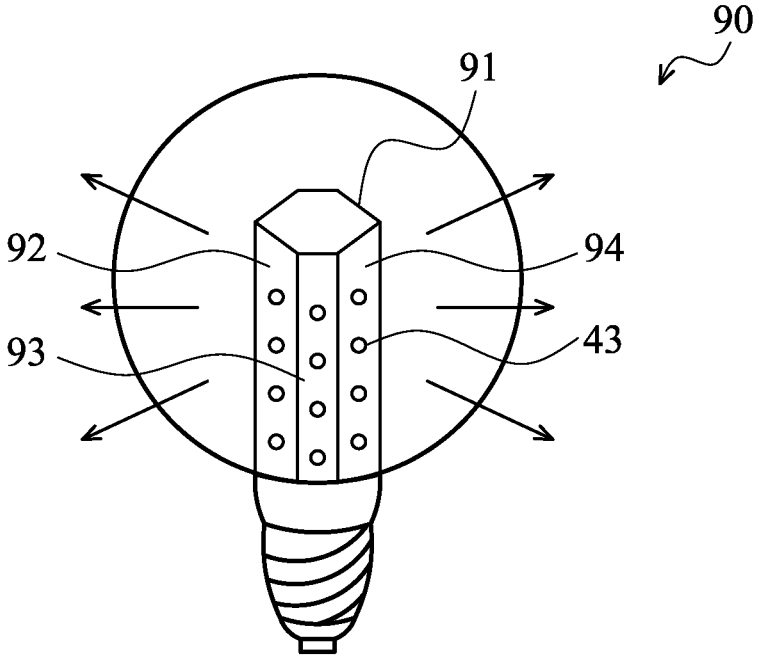
FIG. 1D is a perspective view of an LED-based light bulb, in accordance with some embodiments.

FIG. 1D is a perspective view of an LED-based light bulb 90 known to the inventors. The LED-based light bulb 90 overcomes the problem of limited lighting angles of the light bulb 100 of FIG. 1A by placing the LED-based light emitters 43 on surfaces of a column 91. Such design allows the LEDs to emit light in all directions, including light toward the backside of light bulb 90 to meet the guidelines of ENERGY STAR™. However, the manufacturing cost of LED-based light bulb 90 is quite high, since each surface of column 91 (surfaces 92, 93, 94), which could be part of a plate, needs to be secured, such as by screwed, to another surface of the column 91. Further, the column 91 has limited space to house a cooling device with a large thermal management capacity, which could either limit the number of LED-based light emitters used for LED-based light bulb 90 or could raise the temperature of the LEDs undesirably due to insufficient cooling capacity. The concerns over the manufacturing cost and thermal management limit the applicability of the type of LED-based light bulb 90 shown in FIG. 1D.

Figure 2A:
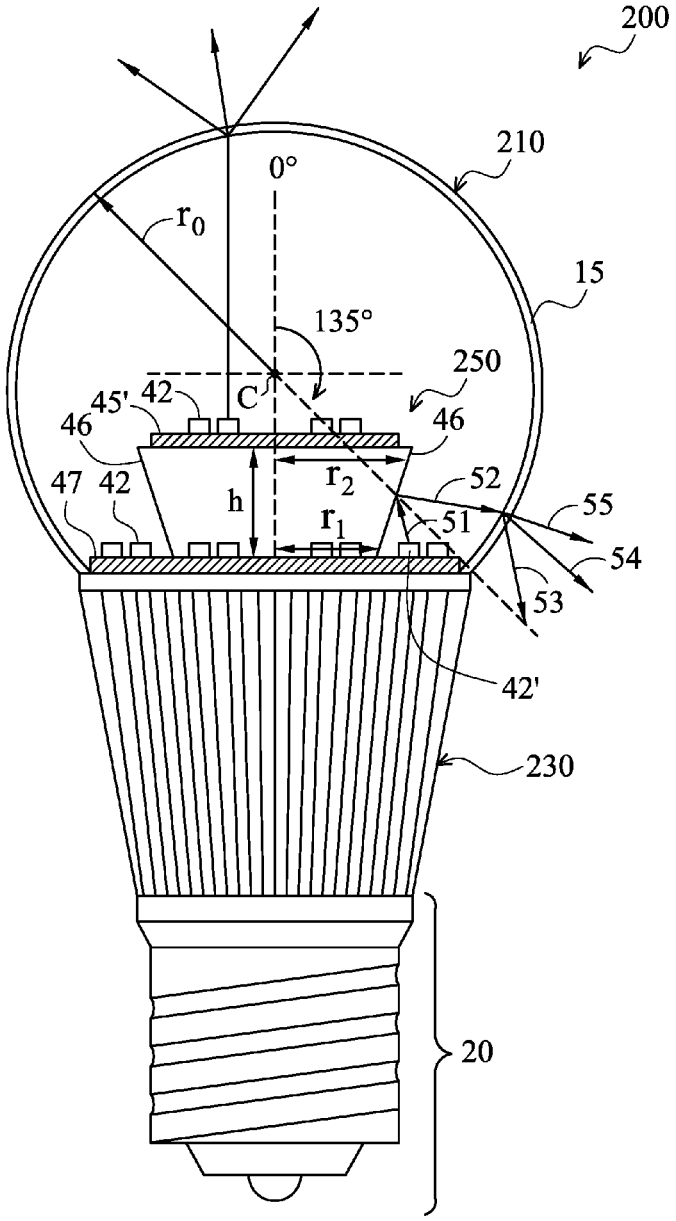
FIGS. 2A-2H are side views of the whole or partial LED-based light bulbs, in accordance with some embodiments.

FIG. 2A is a side view of an LED-based light bulb 200, in accordance with some embodiments, Features or components that are the same or similar to those depicted in FIGS. 1A-1D are labeled with the same reference numerals. The LED-based light bulb 200 has a bulb 210, a base 20, a housing 230, and an LED assembly 250. The base 20 have been described above. The bulb 210 is very similar to the bulb 10 described above. In some embodiments, bulb 210 has a layer 15 of phosphor and/or light diffuser coating. For example, a blue LED light can appear like a white light with a phosphor coating of cerium doped yttrium aluminum garnet (YAGLCe). Other types of phosphor coating material may also be used. In some embodiments, the phosphor coating is directly applied on the LED, instead on the bulb 210. A light diffuser coating, such as silicon, can make the emitted LED light softer and more uniform. In some embodiments, both phosphor and light diffuser materials (or layers) are included in layer (or coating) 15.

The housing 230 is similar to housing 30 of FIG. 1A, in accordance with sonic embodiments. In some other embodiments, the housing 230 may have different size and design from housing 30 to enable additional cooling capacity. For example, the housing 230 may be larger than housing 30 described above to allow installing one or more larger cooling devices. In addition, the housing 230 may have different exterior design, such as fine folds or fins, to enable additional heat dissipation.

The LED assembly 250 includes a number of LED light emitters 42 that are mounted on two levels of substrate surfaces, as shown in FIG. 2A in accordance with some embodiments. FIG. 2A shows that the LED assembly 250 has LED light emitters 42 on two levels of substrates 45' and 47. A number of LED light emitters are on upper substrate 45' and a number of LED light emitters are on lower substrate 47. The LED light emitters on lower substrate 47 are distributed around the LED light emitters 42 on upper substrate 45'. Between upper substrate 45' and lower substrate 47, there is a slanted surface 46, which faces downward to reflect light generated from LED light emitters 42 on the lower substrate 47. Surface 46 has a lower radius $r_1$, which is smaller than the higher radius $r_2$ of surface 46. As a result, surface 46 is slanted downward. FIG. 2A shows that light beam 51 emitted from an LED light emitter 42' is reflected to a direction 52, which is pointed slighted downward toward the backside of bulb 200. The reflected beam 52 then hits the layer 15 of phosphor and/or light diffuser coating. Due to the characteristics of layer 15, the reflected beam 52 may be directed in a number of possible directions 53, 54, or 55, which are all directed (or have high probabilities of being directed) toward the backside of light bulb 200.

FIG. 2A shows the center of light bulb 210 (location "C") and the region of 135° to 180°, where the LED-based light bulb 200 needs to emit at least about 5% of light in accordance with some embodiments. The reflective surface 46 helps direct light beams emitted by LED light emitters on substrate 47 toward the backside of bulb 200. The reflective surface 46 may be made of a highly reflective material, such as a metal, or have a highly reflective coating, such as a coating with white color.

Figure 2D:
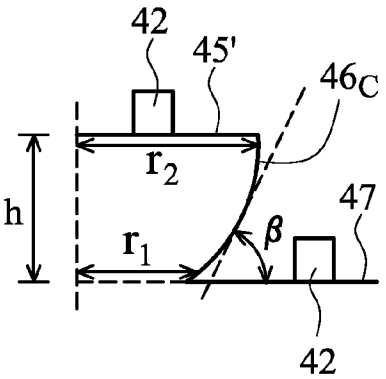
Figure 2C:
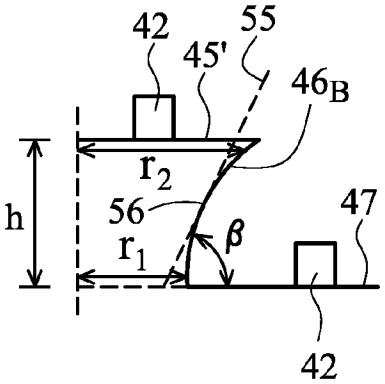
Figure 2B:
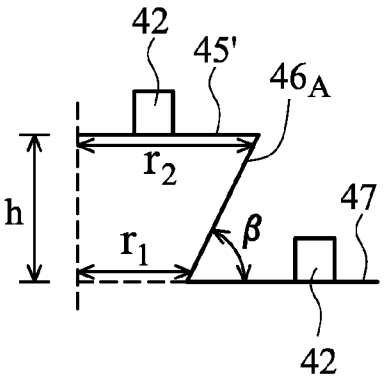

FIGS. 2B-2F are side views of exemplary surface profiles for surface 46, in accordance with some embodiments. FIG. 2B shows that surface $\mathbf{46}_A$ has a straight slope with an angle "β". The angle β is in a range from about 30° to about 85°, in accordance with some embodiments. Lower angles of "β" can help direct more light toward the backside of the bulb 200, in compared to higher angle of "β". However, a lower slope angle "β" would make the lower radius r1 lower, which would limit the space or diameter available for placing a cooling device behind substrate 45', A lower slope angle "β" also could decrease the light efficiency due to additional cycles of reflection of light. A cooling device may also be placed below and be coupled to the lower substrate 47 to dissipate heat generated by the lower LED emitters. In some embodiment, a single cooling device is used to cool both the upper substrate 45' and the lower substrate 47.

Figure 2F:
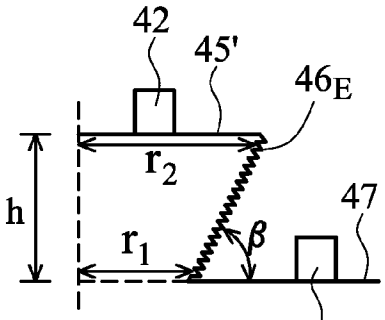
Figure 2E:
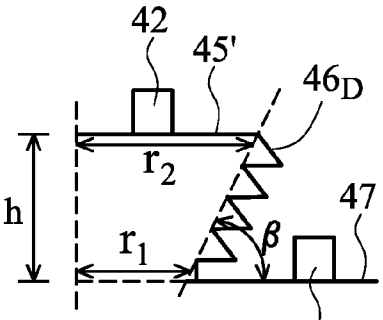

FIG. 2C shows that the surface $\mathbf{46}_B$ is concave, in accordance with some embodiments. The concave surface $\mathbf{46}_B$ is able to direct the light beam more toward the backside of bulb 200, compared to a straight surface $\mathbf{46}_A$ with about the same angle "β". FIG. 2C shows that angle "β" of the concave surface $\mathbf{46}_B$ is defined by the tangential line 55 passing the mid-point 56 of the concave surface $\mathbf{46}_B$. FIG. 2D shows that surface $\mathbf{46}_C$ is convex, in accordance with some embodiments. A convex surface $\mathbf{46}_C$ is also able to direct a portion of light generated from LED light emitter 42 toward the backside of bulb 200. The convex surface $\mathbf{46}_C$ is also at angle "β" with the surface of the lower substrate 47. FIG. 2E shows that the surface $\mathbf{46}_D$ has a saw pattern, in accordance with some embodiments. The saw pattern of surface $\mathbf{46}_D$ shows a number of pointed edges along surface $\mathbf{46}_D$. The surface $\mathbf{46}_D$ is at angle "β" from the surface of the lower substrate 47. FIG. 2F shows the surface $\mathbf{46}_E$ is roughened, in accordance with some embodiments. The overall surface $\mathbf{46}_E$ of FIG. 2F may be straight, curved, or with a saw pattern, as described above, in accordance with some embodiments. The roughened surface may help make the overall light pattern of bulb 10 softer. The patterns described above in FIGS. 2B-2F are merely examples. Other patterns of surface 46 are also possible.

The shape and slope of surface 46 can be made to enable sufficient light directed toward the backside of bulb 200 to meet the requirement defined by ENERGY STAR™ for LED-based light bulbs. The $r_1$ is kept as large as possible, in some embodiments, to allow sufficient space to house a cooling devices for LED light emitters 42 on substrate 45'. In some embodiments, the radius $r_1$ is in a range from about 4 mm to about 28 mm. In some embodiments, the radius $r_2$ is in a range from about 5 mm to about 30 mm. In some embodiments, the ratio of $r_1/r_2$ is in a range from about 0.4 to about 0.95. The height of the substrate 45' is "h". In some embodiments, the height is in a range from about 5 mm to about 30mm.

Figure 2G:
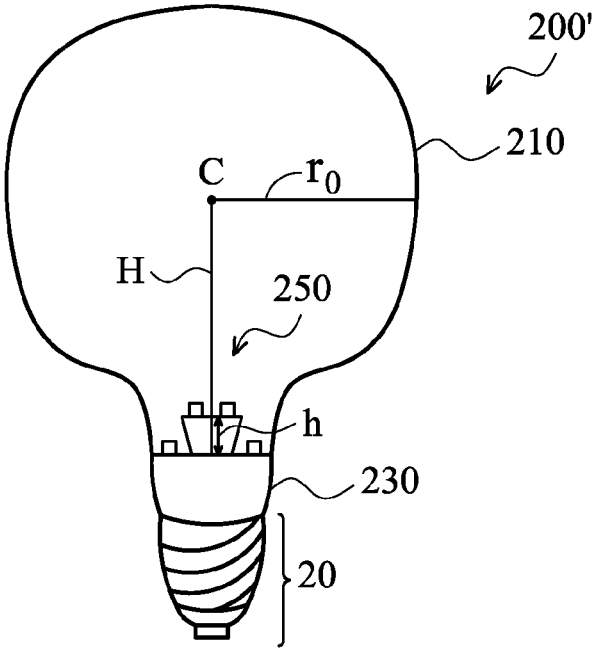
Figure 2H:
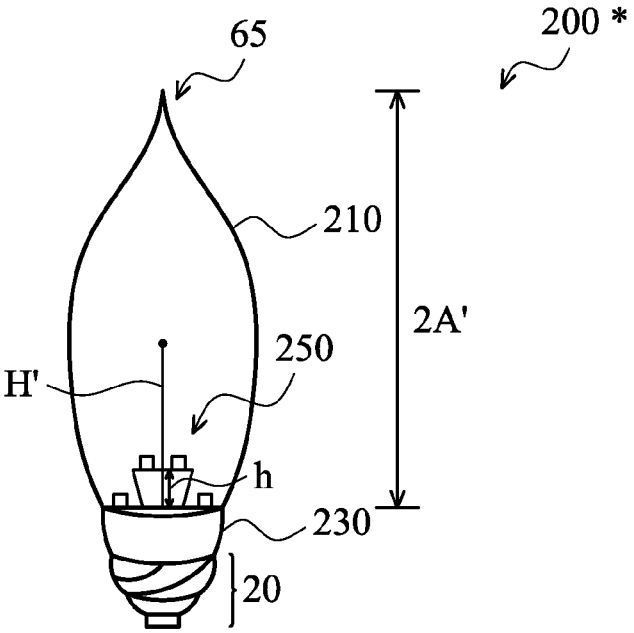

In some embodiments, bulb 210 has a shape of a partial sphere, as shown in FIG. 2A, with a radius of $r_0$. The height of substrate 45' is h. In some embodiments, the ratio of $h/r_0$ is in a range from about 0.2 to about 0.5. In some embodiments, the bulb 210 has a shape of a partial sphere with an elongated neck connected to the housing 230, as shown in FIG. 2G. The distance between the center of the sphere and the top of the housing 230 is "H". In some embodiments, the ratio or h/H is in a range from about 0.1 to about 0.5. In some embodiments, the bulb 210 is elongated with a pointed bulb tip 65, as shown in FIG. 2H. The center of the bulb 210 is defined to be at one half of the total height 2H' (from the tip 65 to the top of the housing 230). In some embodiments, the ratio or h/H' is in a range from about 0.1 to about 0.5.

Figure 3A:
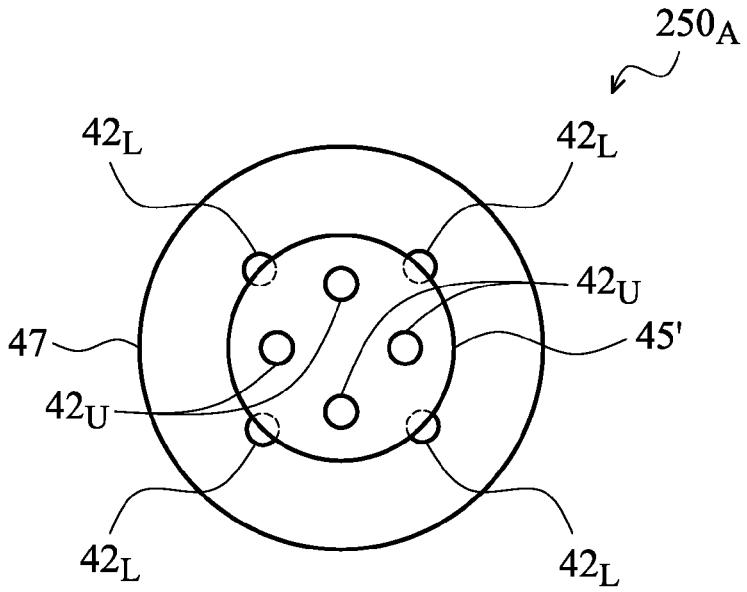
FIGS. 3A-3D and 3F are top views of LED assemblies, in accordance with some embodiments.
Figure 3B:
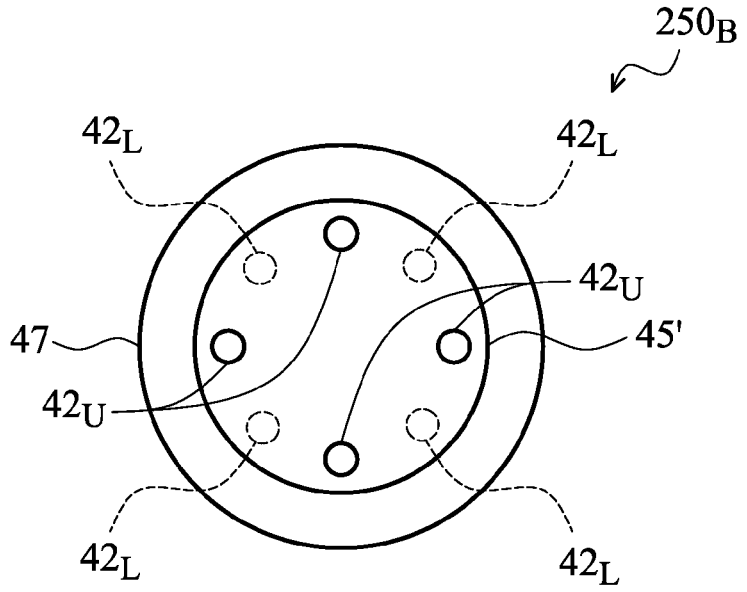

FIGS. 2A-2H are side views of the whole or partial LED-based light bulbs 200, 200', 200*, in accordance with some embodiments. FIGS. 3A-3D and 3F are top views of LED assemblies 250, in accordance with some embodiments. FIG. 3A shows a number of LED-based light emitters $\mathbf{42}_U$ on upper substrate 45' and a number of LED-based light emitters $\mathbf{42}_L$ on the lower substrate 47. FIG. 3A shows that the emitters $\mathbf{42}_U$ are evenly distributed on upper substrate 45' and emitters $\mathbf{42}_L$, are also evenly distributed around upper substrate 45' to provide even coverage around LED-based light bulb 200 (or bulb 10). As depicted in FIG. 3A, portions of emitters $\mathbf{42}_L$ are obstructed by substrate 45' when observed from the top of the assembly $\mathbf{250}_A$. Since the lower radius ($r_1$) of surface 46 is smaller than the radius ($r_2$) of upper substrate 45', it's possible that portions of emitters $\mathbf{42}_L$ are positioned underneath the upper substrate 45', A portion of light generated by emitters $\mathbf{42}_L$ can point toward the front side of bulb 10 (or LED-based light bulb 200). FIG. 3B shows a top view very similar to the top view of FIG. 3A, with the exception that the lower emitters $\mathbf{42}_L$ are totally blocked by substrate 45'When observed from the top of the assembly $\mathbf{250}_B$ in accordance with some embodiments. For LED-based light bulb with the design shown in FIG. 3B, the light from the lower emitters $\mathbf{42}_L$ is mostly used to light up the backside of bulb 200 (or bulb 10).

Figure 3C:
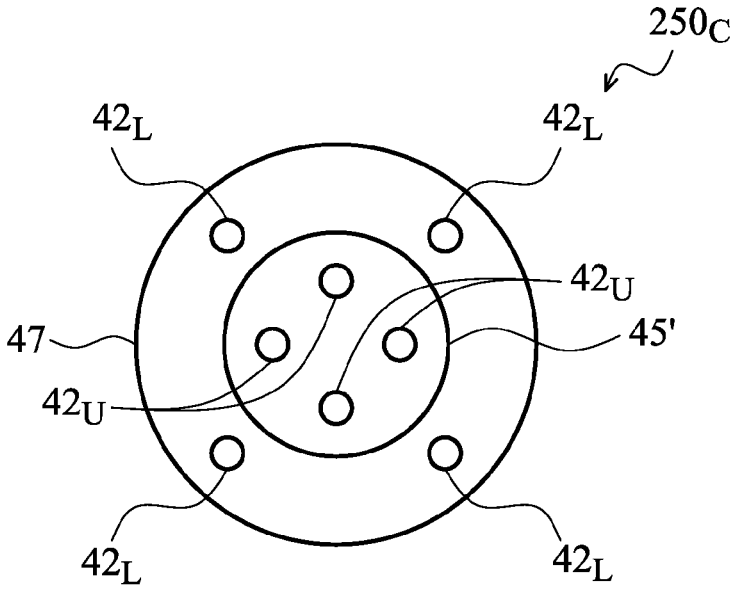

FIG. 3C shows a top view similar to the top view of FIG. 3A, in accordance with some embodiments. However, the lower emitters $\mathbf{42}_L$ are not blocked by substrate 45' when observed from the top of the assembly $\mathbf{250}_C$. For LED-based light bulb with the design shown in FIG. 3C, the light from the lower emitters $\mathbf{42}_L$ contributes to lighting the front side of bulb 10 and also backside of bulb 10. The embodiment shown in FIG. 3A also has similar function. More light goes to the backside of the bulb 200 (or bulb) for the embodiment of FIG. 3A compared to the embodiment of FIG. 3C.

Figure 3D:
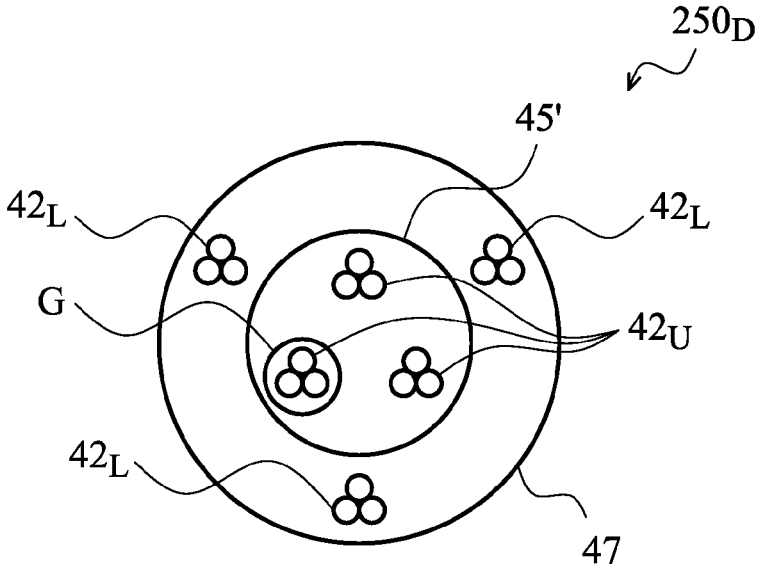
Figure 3E:
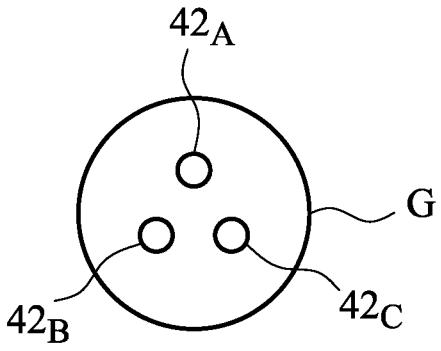
FIG. 3E is an enlarged view of a group of emitters encircled by a circle, in accordance with some embodiments.

In some embodiments, multiple LEDs are placed near each other to generate light of a predetermined color. For example, a blue, a red and a green LEDs can be placed together to generate a white light. FIG. 3D shows a few groups of emitters 42 are placed on substrate 45'and substrate 47, in accordance with some embodiments. Each individual group of emitters 42 has an emitter $\mathbf{42}_A$ an emitter $\mathbf{42}_B$, and an emitter $\mathbf{42}_C$, in accordance with some embodiments. For example, emitter $\mathbf{42}_A$ can emit blue light and emitter $\mathbf{42}_B$ can emit red light. In addition, emitter $\mathbf{42}_C$ can emit green light. FIG. 3E shows an enlarged view of a group of emitters 42 encircled by a circle "G", in accordance with some embodiments. These three emitters are place near each other to generate a light that is close to a white light, in accordance with some embodiments. The upper groups of emitters are distributed evenly on substrate 45'. The lower groups of emitters are also distributed evenly on substrate 47. The example shown and described in FIGS. 3D and 3E uses a number of LED emitters, such as 3 LED emitters $\mathbf{42}_A$, $\mathbf{42}_B$, and $\mathbf{42}_C$, grouped together to generate a light close to a white light or other particular light color. However, other number of LED emitters, such as 2, 4, 5, etc., can be grouped together to generate light with various colors and intensities.

Figure 3F:
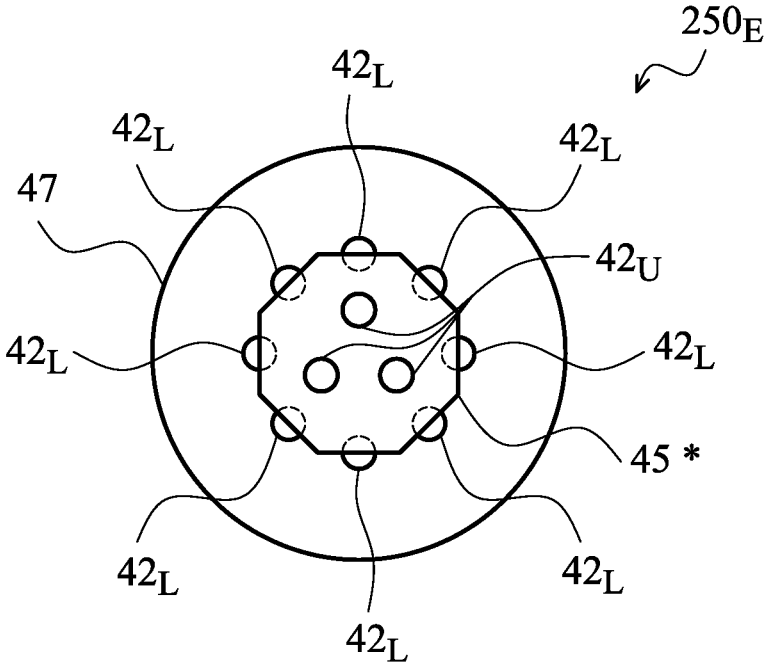
Figure 3G:
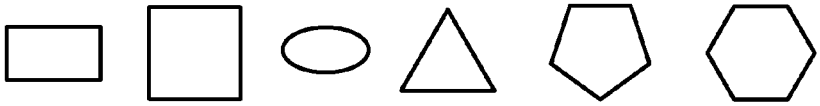
FIG. 3G is a diagram of different shapes of upper and o substrates of an LED assembly, in accordance with some embodiments.

The substrates 45, 45', and 47 for supporting LED-based light emitters, such as emitters 42, $\mathbf{42}_U$, $\mathbf{42}_L$, $\mathbf{42}_A$, $\mathbf{42}_B$, and $\mathbf{42}_C$, are all shown to be in circular shapes. Other shapes of substrates can also be used to support the LED-based light emitters. FIGS. 3F shows an upper substrate 45* with a shape of an octagon for supporting upper-level LED emitters $\mathbf{42}_U$, in accordance with some embodiments. The lower-level LED emitters $\mathbf{42}_L$ are evenly distributed around upper substrate 45*. Other shapes, such as rectangle, square, oval, triangle, pentagon, hexagon, etc., of upper substrate 45', 45* and/or lower substrate 47 are also possible, as shown in FIG. 3G in accordance with some embodiments. Other types of polygons not described above may also be used.

The embodiments of LED assemblies 250, and $\mathbf{250}_A$-$\mathbf{250}_E$ described above show examples of upper and lower substrates (45', 45* and 47) and emitters (42, $\mathbf{42}_U$, $\mathbf{42}_L$, $\mathbf{42}_A$, $\mathbf{42}_B$, and $\mathbf{42}_C$). Different numbers of upper and lower emitters can be placed on the upper and lower support substrates to generate different colors, intensities, and light patterns, ENERGY STAR™ specifies minimal amount of light directed toward the back side of light bulb to be at least 5% in the zone (or region) within 135° to 180°. The application of the present application can be configured to have a light pattern that directs equal to or more than 5% of light toward the backside, if needed.

In some embodiments, the percentage of upper LED emitters $\mathbf{42}_U$ of all the LED emitters ($\mathbf{42}_U$ and $\mathbf{42}_L$) is in a range from about 10% to about 70%. In some other embodiments, the percentage of upper LED emitters 42 is in a range from about 30% to about 50%. Different designs of the LED assembly 250 having different bulb shapes and the optional layer 15 of phosphor and/or light-diffuser coating can generate different light colors, intensities and patterns.

The embodiments of an LED-based light bulb and an LED assembly described above provide mechanisms of reflecting generated by LED emitters toward the back of the LED-based light bulb. An upper substrate and a lower substrate are used to support upper and lower LED emitters. A slanted and reflective surface between the upper substrate and the lower substrate reflects light generated by the lower LED emitters toward the backside of the LED-based light bulb.

In some embodiments, a light-emitting-diode-based (LED-based) light bulb is provided. The LED-based light bulb includes a bulb, and a housing. The bulb is disposed on the housing. The LED-based light bulb also includes a base, and the housing is disposed on the base. The base is configured to make electrical contact of a power source. The LED-based light bulb further includes an LED assembly. The LED assembly includes an upper substrate for supporting one or more upper LED emitters and a lower substrate for supporting a plurality of lower LED emitters, and a top surface of the lower substrate is at least at the same level as an interface between the bulb and the housing. The LED assembly also includes a reflective surface extending between an outer edge of the upper substrate and an inner edge of the lower substrate. The reflective surface is configured to direct at least a portion of light generated by the lower LED emitters toward a backside of the LED-based light bulb.

In some other embodiments, an LED assembly for an LED-based light bulb is provided. The LED assembly includes an upper substrate for supporting one or more upper LED emitters, and a lower substrate for supporting a plurality of lower LED emitters. The LED assembly also includes a reflective surface disposed between the upper substrate and the lower substrate, and an outer edge of the upper substrate is connected to an inner edge of the lower substrate by the reflective surface. The reflective surface is slanted away from the bulb, and the reflective surface reflects light generated by the lower LED emitters toward the backside of the LED-based light bulb.

In yet some other embodiments, an LED assembly for an LED-based light bulb is provided. The LED assembly includes a lower substrate for supporting a plurality of lower LED emitters, and an upper substrate for supporting one or more upper LED emitters. A top surface of the upper substrate has a height above the top surface of the lower substrate, wherein the height is in a range from about 5 mm to about 30 mm. The LED assembly also includes a reflective surface disposed between the upper substrate and the lower substrate, and an outer edge of the upper substrate is connected to an inner edge of the lower substrate by the reflective surface. The reflective surface is slanted away from the bulb, and wherein the reflective surface reflects light generated by the lower LED emitters toward the backside of the LED-based light bulb.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. It is understood, however, that these advantages are not meant to be limiting, and that other embodiments may offer other advantages. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A light-emitting-diode-based (LED-based) light bulb, comprising:

a bulb;

a housing, wherein the bulb is disposed on the housing;

a base, wherein the housing is disposed on the base, and wherein the base is configured to make electrical contact of a power source; and an LED assembly, wherein the LED assembly includes an upper substrate for supporting one or more upper LED emitters and a lower substrate for supporting a plurality of lower LED emitters, wherein the lower substrate is at the same level as, or higher than, an interface between the bulb and the housing, and wherein the LED assembly also includes a reflective surface extending between an outer edge of the upper substrate and an inner edge of the lower substrate, wherein the reflective surface is configured to direct at least a portion of light generated by the lower LED emitters toward a backside of the LED-based light bulb, and wherein the reflective surface has a surface profile between the upper substrate and the lower substrate, the surface profile comprising a saw-patterned, or roughened profile, and wherein the inner edge of the lower substrate has a first radius and the outer edge of the upper substrate has a second radius, and wherein a ratio of the first radius to the second radius is in a range from about 0.4 to about 0.95.

2. The LED-based light bulb of claim 1, wherein the reflective surface and the lower substrate defines an angle ranging from about 30° to about 85° .

3. The LED-based light bulb of claim 1, wherein a percentage of the upper LED emitters of all LED emitters of the LED-based light bulb is in a range from about 30% to about 50%.

4. The LED-based light bulb of claim 1, wherein a top surface of the upper substrate has a height above the top surface of the lower substrate, wherein the height is in a range from about 5 mm to about 30 mm.

5. The LED-based light bulb of claim 4, wherein the bulb has a bulb radius and wherein a ratio of the height to the bulb radius is in a range from about 0.2 to about 0.5.

6. The LED-based light bulb of claim 1, wherein a portion of the light generated by the lower LED emitters that is reflected by the reflective surface falls in a region between about 135° to about 180° or between about −135° to about −180° from a front center of the LED-based light bulb, and wherein the portion of light is at least 5% of the overall light emitted by the LED-based light bulb.

7. The LED-based light bulb of claim 1, wherein the lower LED emitters are at least partially covered by the upper substrate when viewed from above the upper substrate.

8. The LED-based light bulb of claim 1, wherein the shape of the upper substrate comprises circle, rectangle, square, oval, triangle, pentagon, hexagon, or octagon.

9. The LED-based light bulb of claim 1, wherein the bulb is coated with a layer of phosphor coating, light diffuser coating, or a combination thereof.

10. The LED-based light bulb of claim 1, further comprising: a cooling device coupled to upper substrate to dissipate heat generated by the upper LED emitters.

11. The LED-based light bulb of claim 1, further comprising: a cooling device coupled to lower substrate to dissipate heat generated by the lower LED emitters.

12. The LED-based light bulb of claim 1, further comprising:

an electrical circuit assembly, wherein the electrical circuit assembly adjusts power taken in from the power source to current and/or voltage for lighting the upper and lower LED emitters.

13. The LED-based light bulb of claim 1, wherein the reflective surface is made of a reflective metal or has a white reflective coating.

14. An LED assembly for an LED-based light bulb, comprising:

an upper substrate for supporting one or more upper LED emitters, wherein the upper substrate has a first radius;

a lower substrate for supporting a plurality of lower LED emitters, wherein the lower substrate has a second radius, and wherein a ratio of the second radius to the first radius is in a range from about 0.4 to about 0.95; and a reflective surface disposed between the upper substrate and the lower substrate, and wherein an outer edge of the upper substrate is connected to an inner edge of the lower substrate by the reflective surface, and wherein the reflective surface is slanted away from the LED-based light bulb, and wherein the reflective surface reflects light generated by the lower LED emitters toward the backside of the LED-based light bulb.

15. The LED assembly of claim 14, wherein the reflective surface is at an angle with the top surface of the lower substrate, and wherein the angle is in a range from about 30° to about 85° .

16. The LED assembly of claim 14, wherein the reflective surface has a surface profile between the upper substrate and the lower substrate selected from a group consisting of saw-patterned and roughened.

17. The LED assembly of claim 14, wherein the inner edge of the lower substrate has a first radius and the outer edge of the upper substrate has a second radius, and wherein a ratio of the first radius to the second radius is in a range from about 0.4 to about 0.95.

18. An LED assembly for an LED-based light bulb, comprising:

a lower substrate for supporting a plurality of lower LED emitters;

an upper substrate for supporting one or more upper LED emitters, wherein a top surface of the upper substrate has a height above the top surface of the lower substrate, wherein the height is in a range from about 5 mm to about 30 mm;

a reflective surface disposed between the upper substrate and the lower substrate, and wherein an outer edge of the upper substrate is connected to an inner edge of the lower substrate by the reflective surface, and wherein the reflective surface is slanted away from the LED-based light bulb, and wherein the reflective surface reflects light generated by the lower LED emitters toward the backside of the LED-based light bulb; and a bulb that covers the lower substrate and the upper substrate, wherein the bulb has a shape of a partial sphere having a radius, and wherein a ratio of the height of the upper substrate to the radius of the bulb is in a range from about 0.2 to about 0.5.

19. The LED assembly of claim 18, wherein the reflective surface has a saw-patterned or roughened surface profile.

* * * * *